US008175321B2

(12) United States Patent
Bryant et al.

(10) Patent No.: US 8,175,321 B2
(45) Date of Patent: May 8, 2012

(54) SPEAKER MOTOR AND SPEAKER

(75) Inventors: Douglas Bryant, Centerport, NY (US); Michael A. Ketchell, Patchogue, NY (US)

(73) Assignee: Samson Technologies Corporation, Hauppauge, NY (US)

( * ) Notice: Subject to any disclaimer, the term of this patent is extended or adjusted under 35 U.S.C. 154(b) by 351 days.

(21) Appl. No.: 12/520,183

(22) PCT Filed: Jan. 12, 2007

(86) PCT No.: PCT/US2007/000973
§ 371 (c)(1),
(2), (4) Date: Jun. 19, 2009

(87) PCT Pub. No.: WO2008/085177
PCT Pub. Date: Jul. 17, 2008

(65) Prior Publication Data
US 2010/0092023 A1 Apr. 15, 2010

(51) Int. Cl.
*H04R 1/00* (2006.01)
*H04R 9/06* (2006.01)
*H04R 11/02* (2006.01)

(52) U.S. Cl. ..... 381/423; 381/396; 381/397

(58) Field of Classification Search ..... 381/396, 381/397, 400, 412, 423, 424, 426–428; 181/166, 181/167, 173, 174
See application file for complete search history.

(56) References Cited

U.S. PATENT DOCUMENTS

| | | | | |
|---|---|---|---|---|
| 2,004,735 | A | 6/1935 | Thomas | |
| 2,071,828 | A | 2/1937 | Glen | |
| 3,152,661 | A | 10/1964 | Wolff | |
| 3,718,779 | A | 2/1973 | Schoengold | |
| 4,128,138 | A | 12/1978 | Ishii et al. | |
| 4,135,601 | A | 1/1979 | Tsukagoshi et al. | |
| 4,254,184 | A | 3/1981 | Tsukagoshi et al. | |
| 5,390,257 | A | 2/1995 | Oslac et al. | |
| 5,425,107 | A | 6/1995 | Bertagni et al. | |
| 5,714,722 | A | 2/1998 | Noponen | |
| 5,894,524 | A | 4/1999 | Kotsatos et al. | |
| 5,909,015 | A | 6/1999 | Yamamoto et al. | |
| 6,857,501 | B1 | 2/2005 | Han et al. | |
| 6,929,092 | B2 | 8/2005 | Abe et al. | |
| 7,027,609 | B2 | 4/2006 | Kudo et al. | |
| 7,039,211 | B2 * | 5/2006 | Werner | 381/343 |
| 2002/0025059 | A1 | 2/2002 | Kudo et al. | |

FOREIGN PATENT DOCUMENTS

| | | |
|---|---|---|
| GB | 451 178 | 7/1936 |

OTHER PUBLICATIONS

Supplementary European Search Report dated May 26, 2011, from corresponding European Application No. 07 74 8902.
International Search Report and Written Opinion dated Feb. 20, 2008 from the corresponding PCT/US2007/000973.

* cited by examiner

*Primary Examiner* — Tuan Nguyen
(74) *Attorney, Agent, or Firm* — Katten Muchin Rosenman LLP

(57) ABSTRACT

A diaphragm for a speaker includes two portions. The first portion is made of metallic material for producing a high frequency tone. The second portion is made of a non-metallic material for producing a low frequency tone. The first portion is joined at a first peripheral edge to a voice coil while a second peripheral edge is joined at a first peripheral edge of the second portion to form the diaphragm.

18 Claims, 9 Drawing Sheets

SPEAKER MOTOR AND SPEAKER

BACKGROUND OF THE INVENTION

1. Field of the Invention

The invention relates to speakers. In particular, the invention relates to a transducer unit, i.e. motor, having a diaphragm comprising a metallic section and a non-metallic section.

2. Description of the Related Art

A speaker, i.e. loudspeaker, is a transducer, converting electrical signals to mechanical energy. The mechanical energy displaces air to create sound. Since "speaker" may refer to a transducer units as well as one or more "speakers" in a full or partial enclosure, in this application "speaker motor" or "motor" refers to the transducer unit and "speaker" refers to one or more motors in an enclosure.

A speaker motor typically includes, among others, seven (7) basic components, a frame, a magnet assembly, a voice coil, a spider, a diaphragm, and a surround. The frame provides a means to secure the motor in a protective and/or acoustically advantageous enclosure. A magnet assembly is secured to the frame and forms a gap in which a voice coil is able to move.

A flexible damper, i.e. a spider, is secured into the frame above the magnet assembly and is glued to the voice coil to suspend the voice coil in the gap. The wide base of a conical diaphragm is flexibly suspended at a rim at the top of the frame and is rigidly secured to the voice coil.

A changing electrical signal is fed to the voice coil by an amplifier integral with another device or connected in series separate from another device. The changing electrical signal causes fluctuations in the magnetic field of the magnet assembly and the voice coil moves in the gap in relation to the fluctuations. The movement of the voice coil causes the diaphragm to move and displace air to create sound.

While all parts of the motor have an effect on sound quality, the composition of the diaphragm is particularly important. Typically, diaphragms are made of paper. A paper diaphragm excels at low frequency sounds, but distorts high frequency sounds due to the inherent flexibility of paper. Thus, paper diaphragms may be coated with a plasticizing agent.

In other instances, paper diaphragms are supported. For example, U.S. Pat. No. 2,071,828 to Glen appears to teach a paper diaphragm connected directly to the voice coil, but that is supported by a second cone in an apex region where high frequency sounds originate. This second cone is driven by the air in the air gap of the voice coil and helps the paper diaphragm achieve a high resonance.

This characteristic of paper diaphragms makes a motor sound better at certain frequency ranges while sacrificing performance in other ranges. Consequently, the speaker into which a paper diaphragm is built is limited to certain applications to woofers that produce low sounds and to midrange speakers that are suitable for everyday usage.

To produce high frequency sounds, tweeters, which may have a different structure, use a metal diaphragm. The inherent rigidity of aluminum, magnesium, or other lightweight metal or alloys permits metal diaphragms to excel at high frequency sounds. Using the motor structure described above with a metal diaphragm creates a motor that produces better high frequency sounds, but fails to produce adequate low frequency sounds.

Thus, a first need is for a motor that is suitably for a wide range of uses.

A motor with a metal diaphragm has a further draw back. Since metal diaphragms are heavier, the voice coil has more mass to move and, thus, either a stronger electrical signal must be provided to the voice coil or the magnetic field has to be improved. Similarly, to produce a more powerful motor, a stronger electrical signal must be provided to the voice coil or the magnetic field has to be improved.

A "super" magnet, also called a rare earth magnet, may be used to create a greater magnetic field that is capable of lifting a greater mass. Super magnets are typically made of neodymium iron boron, NdFeB. In comparison to ferrite magnets, these super magnets provide additional magnetic strength in a small volume, but lose their magnetism above 80 degrees Centigrade.

Thus, a second need is for a motor that dissipates heat so that a neodymium magnet may maintain its magnetic field.

To improve motors, voice coils may have the number of turns of wire coil increased. However, increasing the number of turns also increases heat proximal to the magnet assembly. Thus, a third need is for a motor that dissipates heat from a voice coil.

These and other needs are met by the present invention.

SUMMARY OF THE INVENTION

These and other needs are met by the present invention. Therein, a diaphragm for a speaker comprises a first and a second portion. The portions are joined to each other at a peripheral edge and meet the need of improved acoustical reproduction and of providing heat dissipation.

The inventive diaphragm comprises a first portion of a metallic material for producing a high frequency tone. The first portion is joined at a first peripheral edge of the first portion to a voice coil. The diaphragm includes a second portion of a non-metallic material for producing a low frequency tone. The second portion is joined at a first peripheral edge of the second portion to a second peripheral edge of the second portion and at a second peripheral edge of the second portion to a diaphragm support.

The metallic portion may be made of aluminum, titanium, magnesium, and an alloy thereof, while the non-metallic portion may be made of paper, polypropylene, carbon fiber, plastic coated paper, or any other suitable non-metallic material.

While in this application "metallic" and "non-metallic" are used, these terms are intended to be used in the broadest possible sense. Thus, "metallic" may also refer to a material that has high heat transfer properties, while "non-metallic" may also refer to a material that has low heat transfer properties.

Preferably, the portions are provided in the diaphragm by a ratio in the range of 1.0:1.0 to 1.0:2.50 of the surface area of the metallic portion to the surface area of the non-metallic portion.

The present invention also includes a speaker motor. The speaker motor comprises a frame; a neodymium iron boron magnet assembly disposed in the frame, and a voice coil suspended in a gap of the magnet assembly. A diaphragm of the speaker motor is configured in the manner described above.

The speaker motor may also be house in a full or partial enclosure and be used as a speaker or indoor or outdoor use, as bass speaker, as midrange speaker, or any other use.

BRIEF DESCRIPTION OF THE INVENTION

Figure 5A:
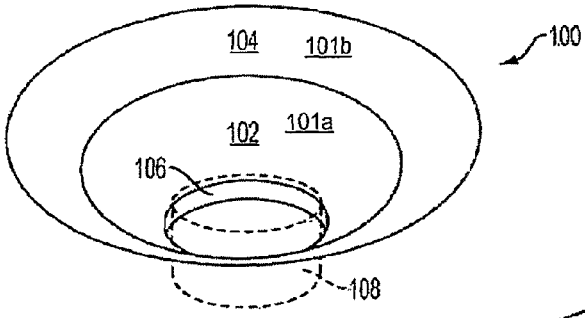
Figure 5B:
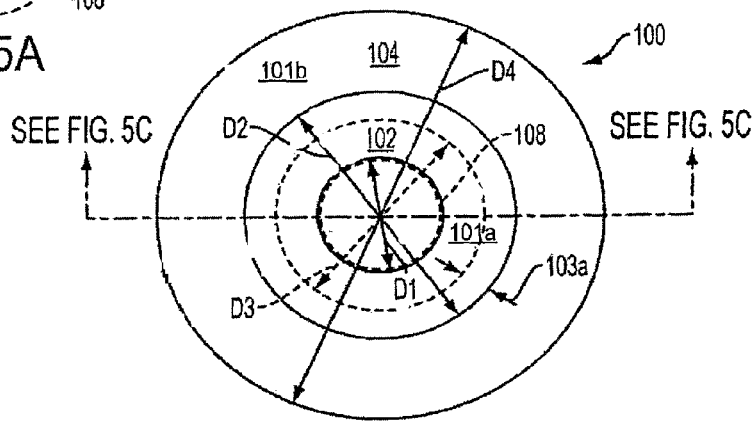
Figure 5C:
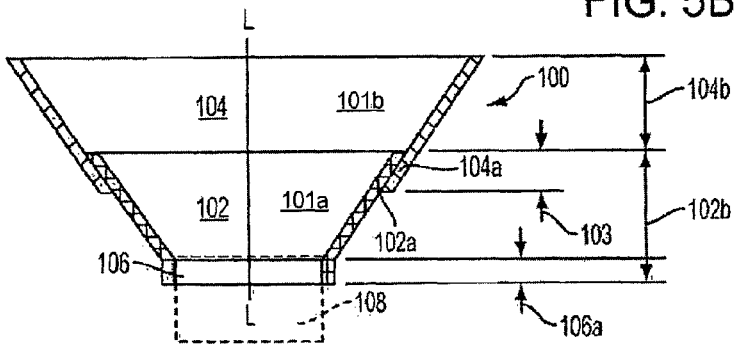

FIGS. 5*a*, 5*b*, and 5*c* are, respectively, a perspective view, a planar view, and a cross-sectional view of a diaphragm in accordance with one embodiment of the present invention.

Figure 5D:
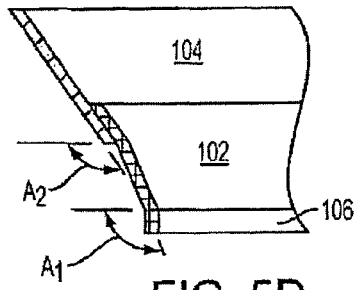

FIG. 5*d* is a partial cross-sectional view of a diaphragm in accordance with one embodiment of the present invention illustrating an embodiment wherein portions of the diaphragm have different angles with respect to a cone.

Figure 6A:
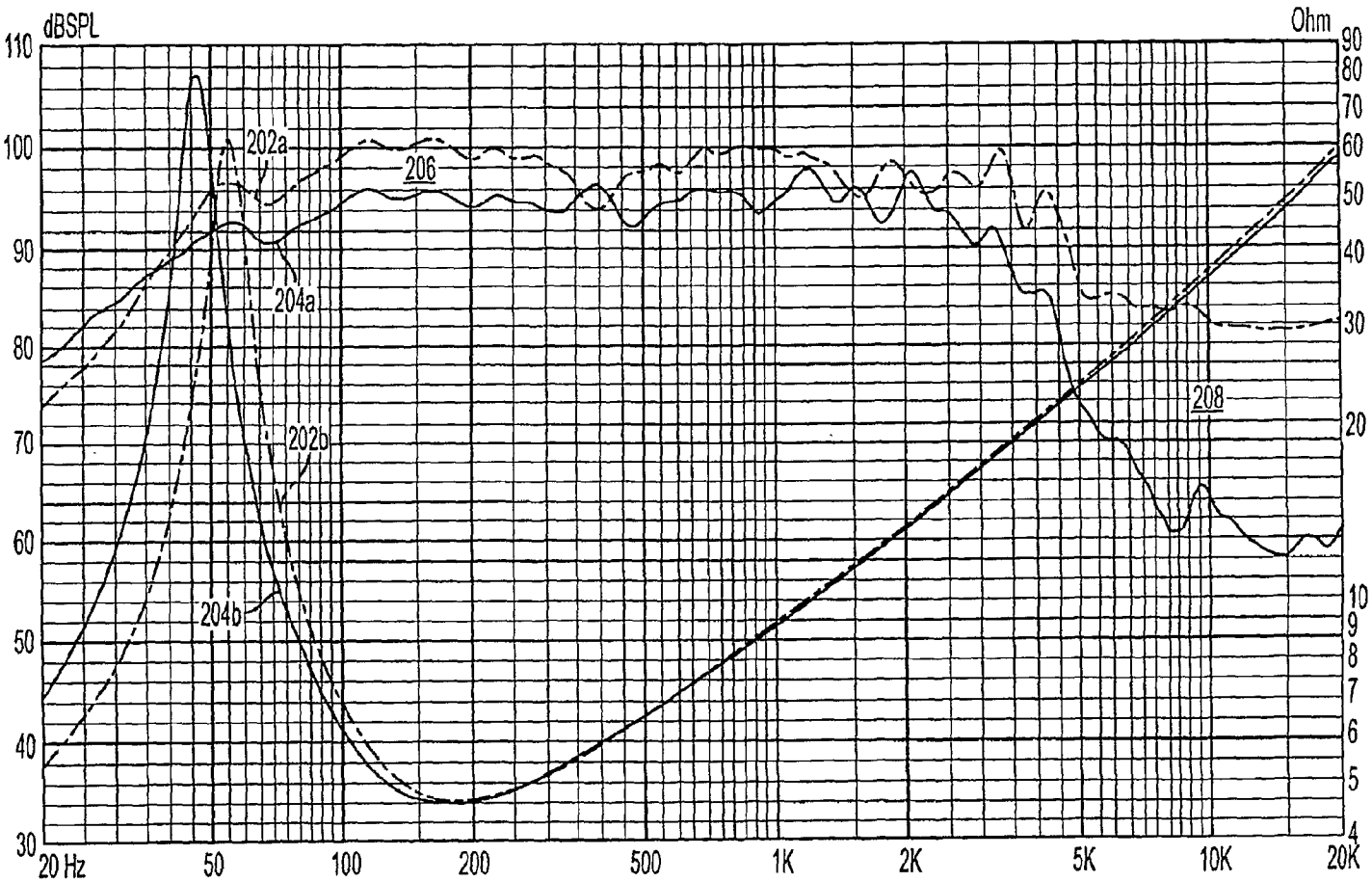
Figure 6B:
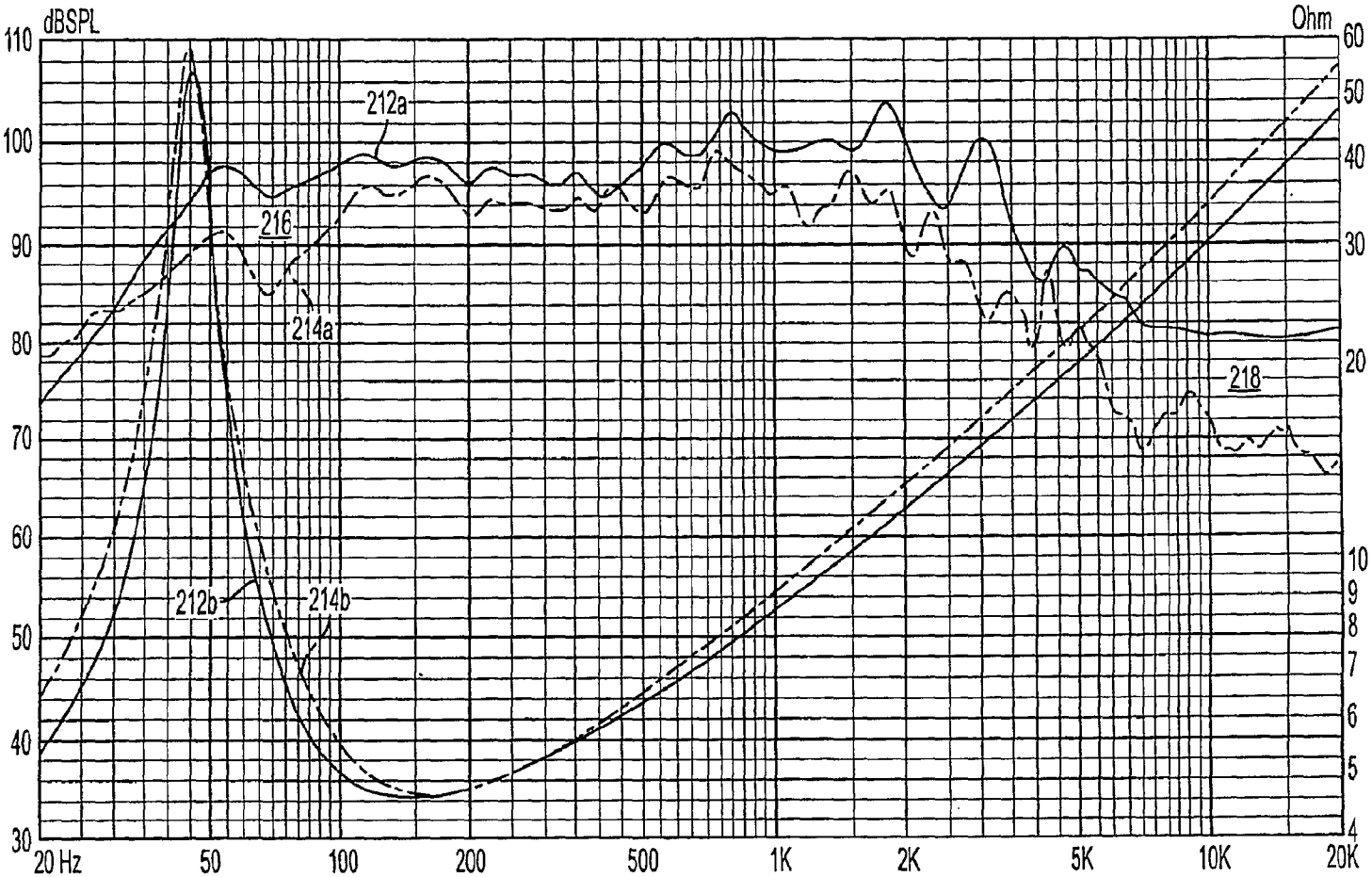

FIGS. 6*a* and 6*b* are graphs tracing the sound pressure level for a certain frequency range and resistance for a certain frequency range for speakers made in accordance with one or more embodiments of the present invention.

Figure 7A:
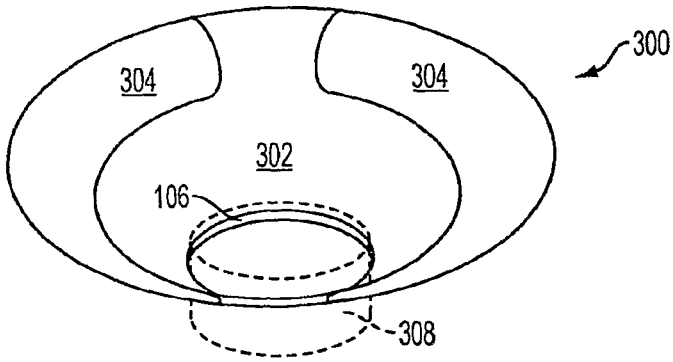
Figure 7B:
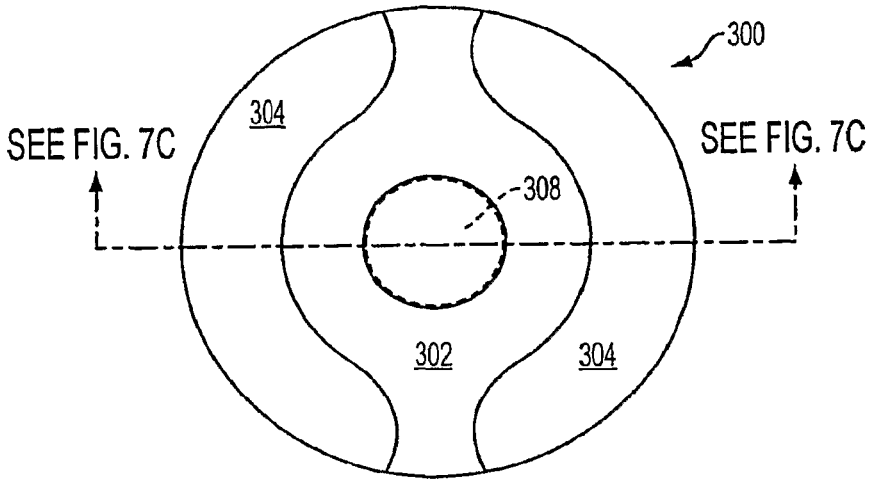
Figure 7C:
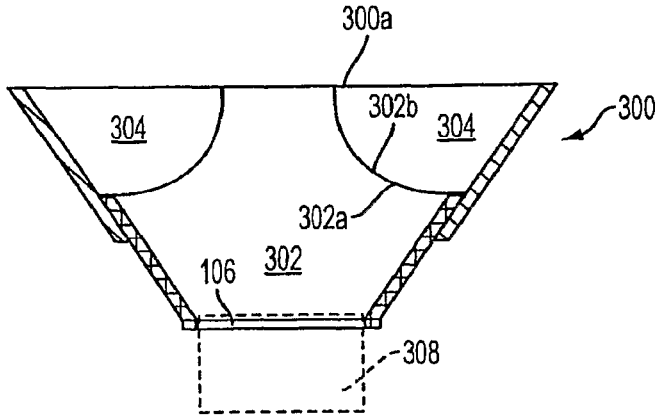

FIGS. 7*a*, 7*b*, and 7*c* are, respectively, a perspective view, a planar view, and a cross-sectional view of a diaphragm in accordance with a further embodiment of the present invention.

Figure 8A:
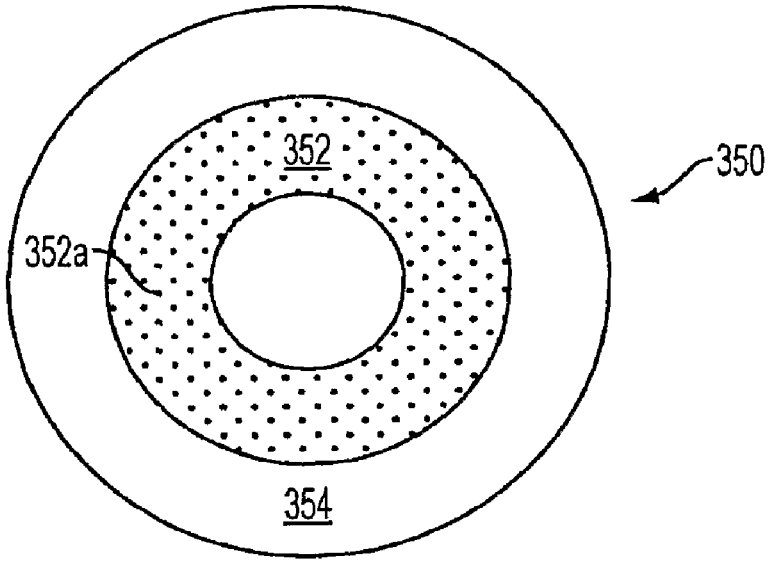
Figure 8B:
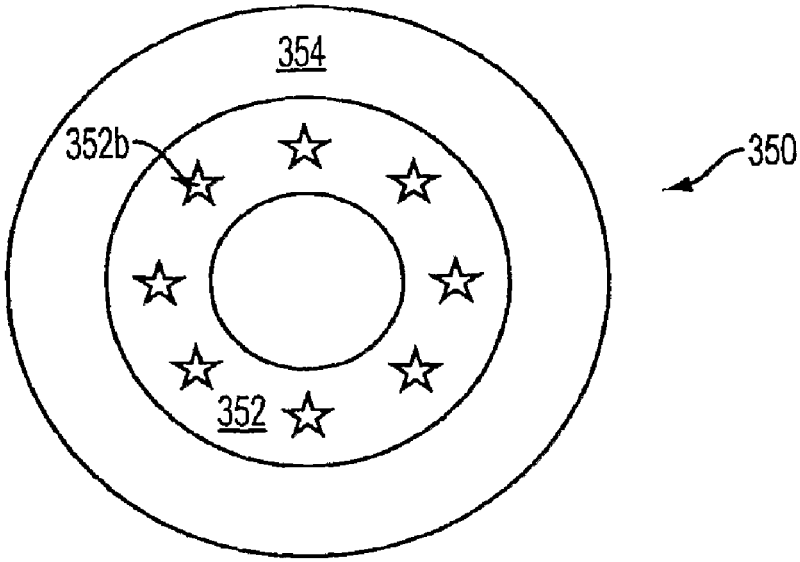

FIGS. 8*a* and 8*b* are planar views of a further embodiment of a diaphragm in accordance with one embodiment of the present invention.

DETAILED DESCRIPTION OF THE INVENTION

Figure 1:
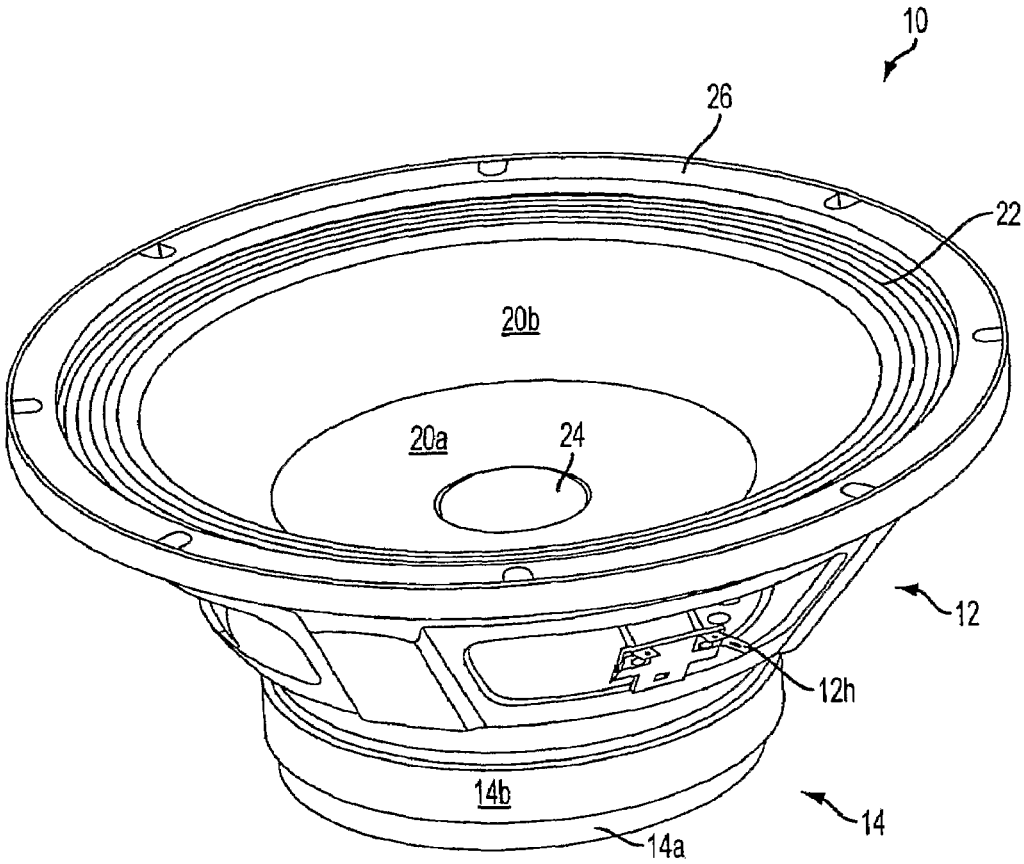
FIG. 1 is an isometric view of a speaker motor in accordance with one embodiment of the present invention.
Figure 2:
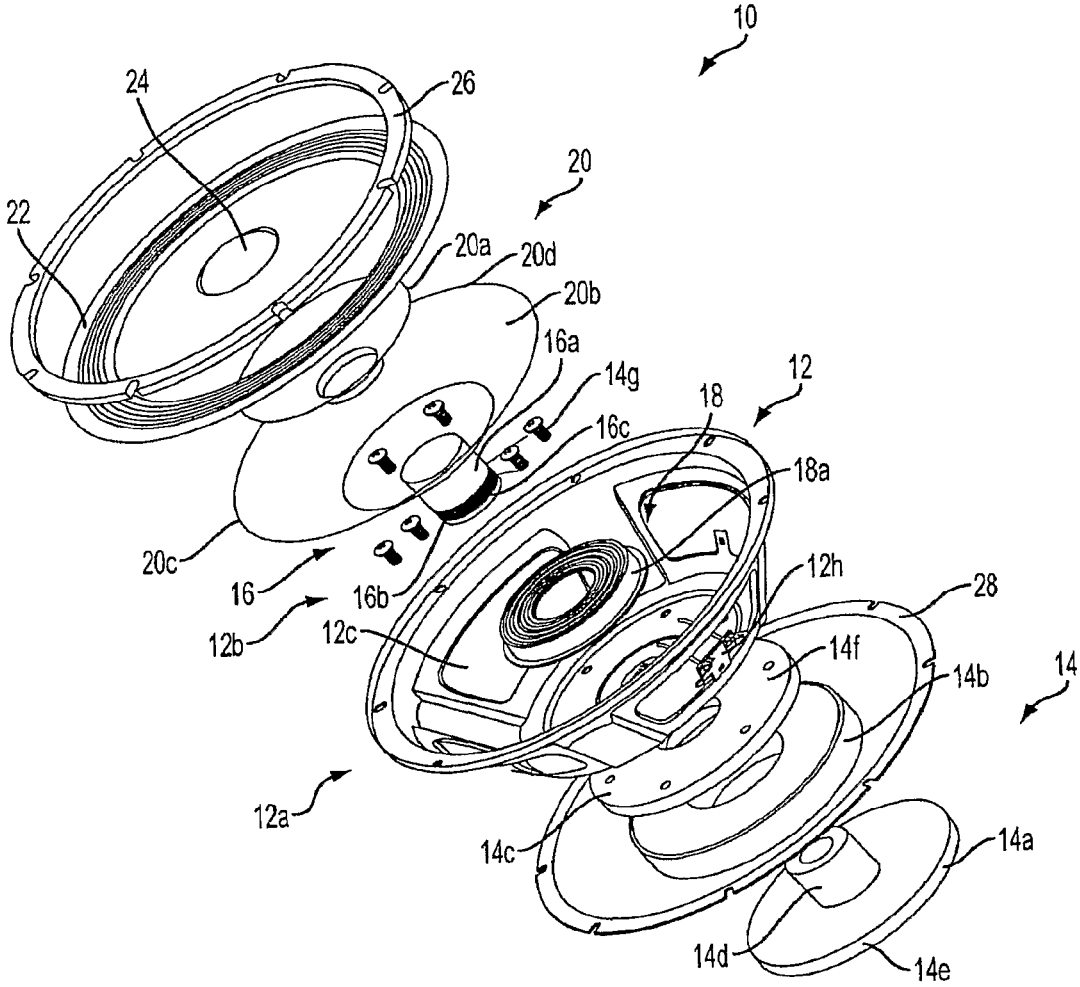
FIG. 2 is an exploded view of FIG. 1.
Figure 3:
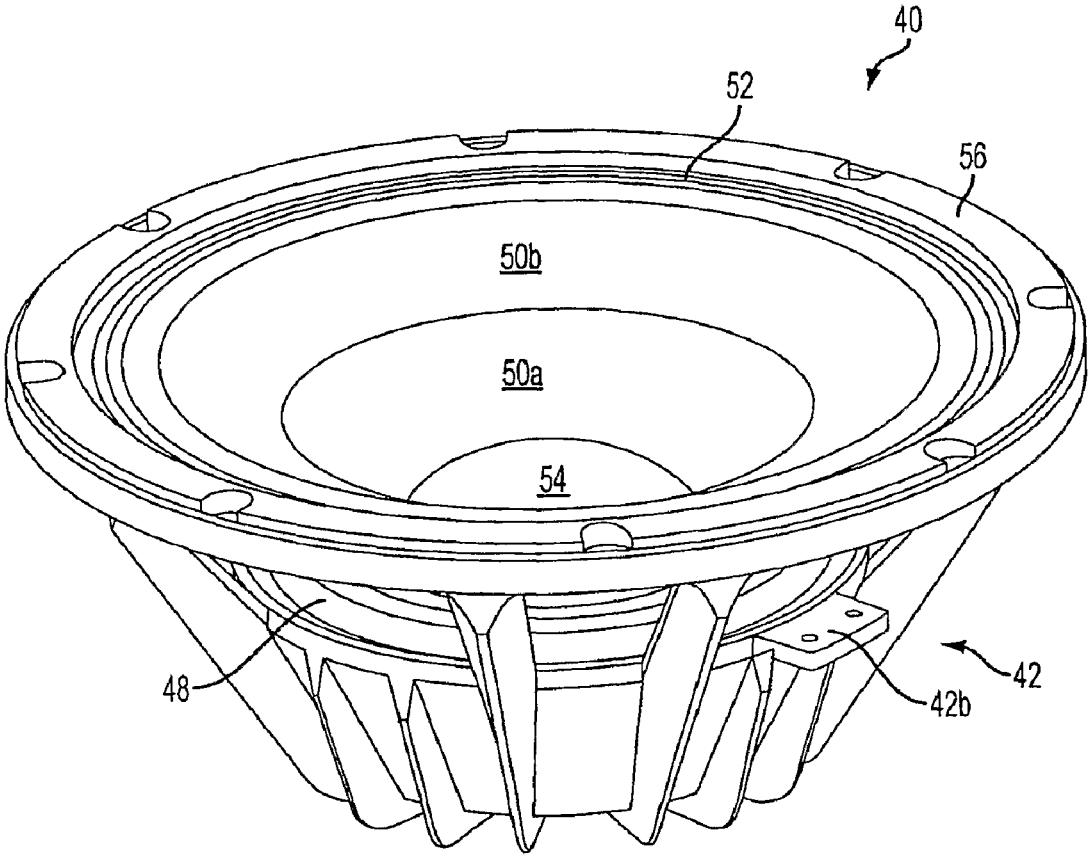
FIG. 3 is an isometric view of a speaker motor in accordance with one embodiment of the present invention.
Figure 4:
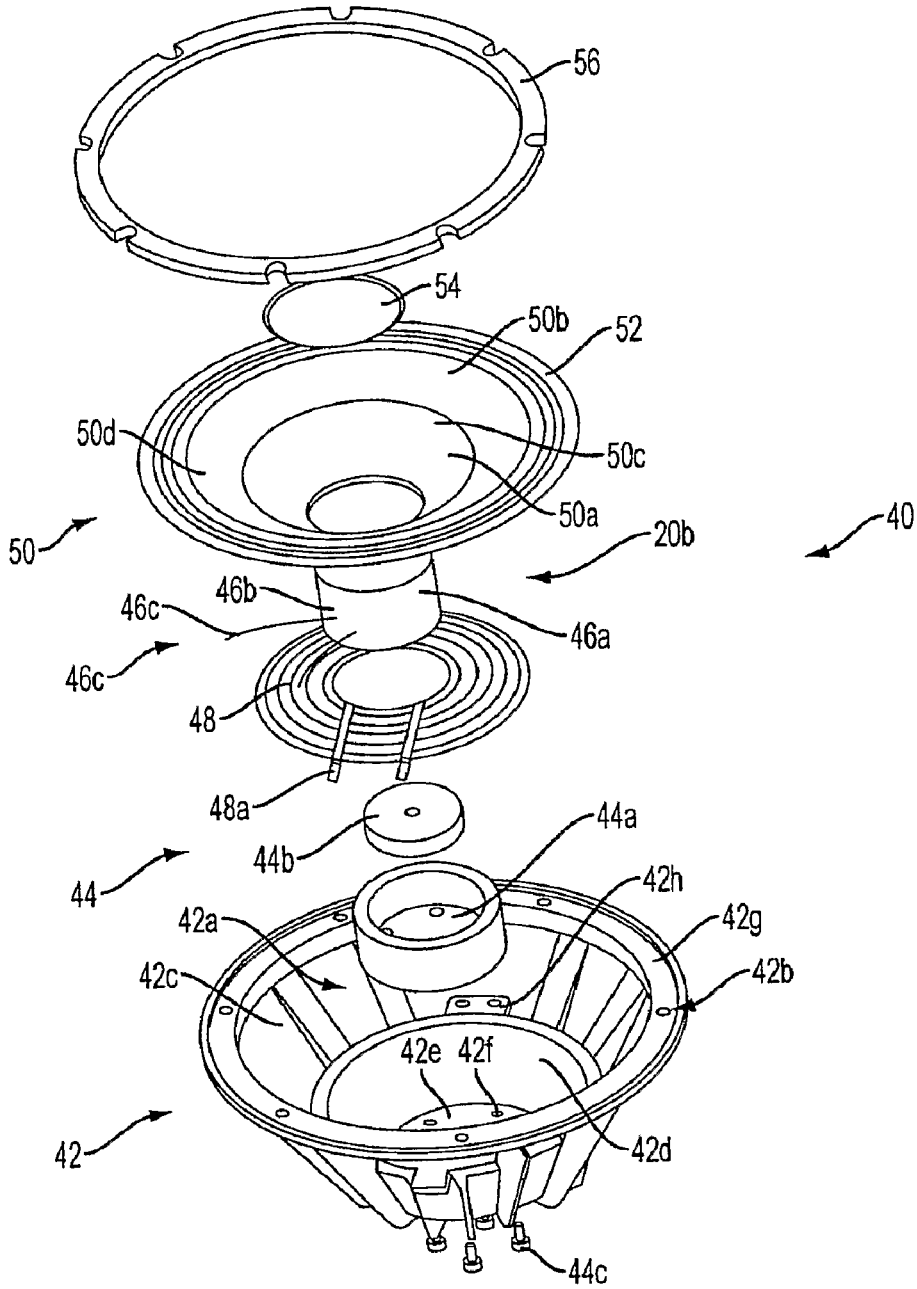
FIG. 4 is an exploded view of FIG. 3.

In accordance with one or more of the embodiment of the present invention, the inventive speaker motor is illustrated with respect to two different styles of speaker motors. FIGS. 1 and 2 illustrate a traditional motor that uses a ferrite magnet assembly and includes a pole piece. FIGS. 3 and 4 illustrate a motor that uses a neodymium iron boron magnet in a cup-style magnet assembly. It should of course be appreciated, that the present invention is not limited to these motor styles.

FIG. 1 is an isometric view of a speaker motor 10 in accordance with one embodiment of the present invention. FIG. 2 is an exploded view of FIG. 1.

Motor 10 includes a frame 12, a magnet assembly 14, and a voice coil 16. Frame 12 provides a framework for mounting the other components of the motor and for mounting the speaker in a full or partial enclosure, as taught below. Frame 12 preferably has a conical shape with an apex 12*a*, i.e. narrow distal end, and a base 12*b*, i.e. wide proximate end, suitable for directing sound waves to the ear of a listener.

Typically, a speaker or motor is sized by a diameter taken at the base of the frame. Herein, motor 10 may have any suitable size to which the frame may be made.

Because the magnet assembly and voice coil can generate significant thermal stresses, frame 12 preferably is made of a durable material, such as cast aluminum and steel, that resists warping and maintains its shape under thermal loading. Frame 12 preferably is also able to withstand a variety of other conditions. For example, motor 10 may be subject to extreme temperature ranges due to use in a car or use in an outdoor public address system. Further, to dissipate heat, frame 12 preferably includes one or more vent openings 12*c*.

To permit mounting of other components one or more mounting holes 12*d* are disposed in a rim 12*e* at apex 12*a* and to permit mounting of the speaker to an enclosure one or mounting holes 12*f* in a rim 12*g* near base 12*b*.

Magnet assembly 14 comprises a pole piece 14*a*, a permanent magnet 14*b*, and a top plate 14*c*. The pole piece, or T Yoke, as is known in the art preferably comprises a base 14*d* configured as a flat plate and a projection 14*e*, i.e. pole, configured as a cylindrical projection. Assembly 14 may also be ceramic or alnico magnet assembly. To dissipate heat, the projection may be configured to be hollow. Preferably, pole piece 14*a* including base 14*d* and projection 14*e* are made drop forged metal.

The permanent magnet may be a ferrite magnet configured as an annular ring. While illustrated here as a ferrite magnet, magnet 14*b* may be any other suitable magnet, including a neodymium magnet.

The top plate is also configured as an annular ring. One more mounting holes 14*f* are disposed in the top plate and match one or more mounting holes 12*d* to secure the top plate to frame 12 via one more mounting screws 14*g*. The magnetic field of magnet 14*b* then connects the magnet to the top plate and to the base of the pole piece to form the magnet assembly 14.

The diameter of the inner space of the magnet and top plate are suitably greater than the diameter of projection 14*e* to create a gap in which voice coil 16 can be inserted and move freely with respect to magnet assembly 14. Voice coil 16 includes a tubular former 16*a* and a coil 16*b* of wire, which have leads 16*c* extending outward from the coil.

The leads connect to terminals 12*h* disposed at a convenient location on the frame and place the voice coil, i.e. motor, in electrical communication with another device, such as an amplifier or a radio.

The former may be any suitable former, but it is preferred that the former is a Kapton former comprising a plastic material suitable to handle increased power and provide excellent electrical insulation and thermal dissipation.

The coil may comprise any type of wire that is suitable. In certain applications, aluminum wire is desired; while in other application, copper wire is preferred. The coil begins and ends in leads 16*c* that extend from the voice coil.

A flexible spider 18 is provided and secured to a rim provided in apex 12*a*. The spider preferably is made of a pervious, shape-maintaining material or materials to hold its shape while dissipating heat. The spider may have a raised edge portion 18*a* to raise the spider above the magnet assembly.

Spider 18 is configured to have an annular shape. Although the spider is also glued to the voice coil, the inner space of the spider is preferably configured to have a diameter that frictionally retains the voice coil along peripheral portion.

A conical diaphragm 20 comprising a plurality of peripheral portions 20*a*, 20*b*, as will be described further below. A lower edge portion 20*c* having an annular shaper is provided on the diaphragm to secure the diaphragm to the voice coil preferably using glue.

A surround 22, also known as a suspension, is secured to a rim at base 12*b* and to a peripheral upper edge 20*d* of the diaphragm to connect the diaphragm to the frame. The surround is preferably made of a flexible, shape-maintaining material such as paper or rubber compound, such as rubber butyl.

A dustcap 24 is preferably made of a pervious material to permit heat dissipation but has a generally domed rigid structure. The dustcap includes a crimped edge 24*a* having an angle to match the conical shape of the diaphragm and which is glued to the diaphragm to seal the voice coil and magnet assembly from ambient conditions.

In accordance with one or more embodiments of the present invention, dustcap 24 (or dustcap 54) below may of a high heat transmissive material, such as a metal.

One or more gaskets 26, 28 are provided to cushion the frame, i.e. motor, with respect to an enclosure when the motor is installed in an enclosure.

When a changing electrical signal is provided the voice coil moves in the gap in relation to the fluctuations and motors the diaphragm to produce sound.

FIG. 3 is an isometric view of a speaker motor 40 in accordance with one embodiment of the present invention. FIG. 4 is an exploded view of FIG. 4.

Motor 40 similar to motor 10 includes a frame 42, a magnet assembly 44, and a voice coil 46 and function similarly. Frame 42 provides a framework for mounting the other components of the motor and for mounting the speaker in a full or partial enclosure, as taught below. Frame 42 preferably has a conical shape with an apex 42*a*, i.e. narrow distal end, and a base 42*b*, i.e. wide proximate end, suitable for directing sound waves to the ear of a listener.

Typically, a speaker or motor is sized by a diameter taken at the base of the frame. Herein, motor 40 may have any suitable size to which the frame may be made.

Because the magnet assembly and voice coil can generate significant thermal stresses, frame 42 preferably is made of a durable material, such as cast aluminum and steel, that resists warping and maintains its shape under thermal loading. Frame 42 preferably is also able to withstand a variety of other conditions. For example, motor 40 may be subject to extreme temperature ranges due to use in a car or use in an outdoor public address system. Further, to dissipate heat, frame 42 preferably includes one or more vent openings 42*c*.

To permit mounting of other components one or more mounting holes 42*d* are disposed in a floor 42*e* at apex 42*a* and to permit mounting of the speaker to an enclosure one or mounting holes 42*f* in a rim 42*g* near base 42*b*.

Magnet assembly 44 comprises a cup 44*a* in which a magnet 44*b* is provided and forms a peripheral gap with the sidewalls of the cup. Cup 44*a* preferably includes a plurality of screw holes that match screw holes 42*d* in floor 42*e* and permit easy installation of the cup to the frame via mounting screws 44*c*.

The magnet preferably is a neodymium boron iron magnet. A voice coils 46 can be inserted and move freely with respect to magnet assembly 44 in a gap between the cup and magnet. To aid in movement of the voice coil and heat dissipation, a thermally conductive grease is used between the cup and magnet.

Voice coil 46 includes a tubular former 46*a* and a coil 46*b* of wire, which have leads 46*c* extending outward from the coil. The leads connect to terminals 42*h* disposed at a convenient location on the frame or to connecting wires on a spider and in either case serve to place the voice coil, i.e. motor, in electrical communication with another device, such as an amplifier or a radio.

The former may be any suitable former, but it is preferred that the former is a Kapton former comprising a plastic material suitable to handle increased power and provide excellent electrical insulation and thermal dissipation.

The coil may comprise any type of wire that is suitable. In certain applications, aluminum wire is desired; while in other application, copper wire is preferred. The coil begins and ends in leads 46*c* that extend from the voice coil.

A flexible spider 48 is provided and secured to a rim provided in apex 42*a*. The spider preferably is made of a pervious, shape-maintaining material or materials to hold its shape while dissipating heat. For example, the spider may be made of a woven impregnated cloth able to resist high temperatures. The spider may include lead wires 48*a* that connect to the voice coil at one end and at the terminals 42*h* at the other end.

Spider 48 is configured to have an annular shape. Although the spider is also glued to the voice coil, the inner space of the spider is preferably configured to have a diameter that frictionally retains the voice coil along peripheral portion.

A conical diaphragm 50 comprising a plurality of peripheral portions 50*a*, 50*b*, as will be described further below. A lower edge portion 50*c* having an annular shaper is provided on the diaphragm to secure the diaphragm to the voice coil preferably using glue.

A surround 52 is secured to a rim at base 42*b* and to a peripheral upper edge 50*d* of the diaphragm to connect the diaphragm to the frame. The surround is preferably made of a flexible, shape-maintaining material such as paper or rubber compound, such as rubber butyl.

A dustcap 54 is preferably made of a pervious material to permit heat dissipation but has a generally domed rigid structure. The dustcap includes a crimped edge 24*a* having an angle to match the conical shape of the diaphragm and which is glued to the diaphragm to seal the voice coil and magnet assembly from ambient conditions.

One or more gaskets 56 are provided to cushion the frame, i.e. motor, with respect to an enclosure when the motor is installed in an enclosure.

When a changing electrical signal is provided the voice coil moves in the gap in relation to the fluctuations and motors the diaphragm to produce sound.

FIGS. 5*a*, 5*b*, and 5*c* are, respectively, a perspective view, a planar view, and a cross-sectional view of a diaphragm in accordance with one embodiment of the present invention. Diaphragm 100 is identical or substantially identical with diaphragm 20 and/or 50 and includes a plurality of peripheral portions 102 and 104 that correspond to portions 20*a*, 50*a*, and 20*b*, 50*b*, respectively, as described above.

Therein, peripheral portion 102 includes a lower edge 106 that is connected to a voice coil 108 (generally indicated by broken lines), which itself is identical or substantially identical to those described above or those taught with respect to Table 1 below.

Peripheral portion 102 preferably comprises a metallic material that serves to dissipate heat from the voice coil and improves the resonance of the motor at high frequencies. The metallic material may be aluminum, magnesium, titanium, or an alloy thereof or any other metallic or non-metallic heat conducting materials and may have any suitable thickness.

While in this application "metallic" and "non-metallic" are used, these terms are intended to be used in the broadest possible sense. Thus, "metallic" may also refer to a material that has high heat transfer properties, while "non-metallic" may also refer to a material that has low heat transfer properties.

Thus, for example portion 102 may also be a thermally conductive plastic, such as those made by TDL Plastics, Corpus Christi, Tex., U.S.A., or other material yet to be invented.

Portion 102 is preferably cold or hot-formed in one piece from a sheet of material. Portion 102 may also be stamped. Portion 102 may be anodized for strength and/or colored.

Portion 102 may comprise a substantially annular shape having an inner diameter D1 that is larger than the diameter of the voice coil. An outer diameter D2 forms an outer edge of portion 102. Portion 102 comprises a length 102*b* parallel to the longitudinal axis L-L. Lower edge 106 preferably has the same inner diameter and may have any suitable dimension 106*a*.

Preferably, portion 102 is joined to a voice coil former comprising plastic using a thermally conductive epoxy while a portion 102 is joined to a voice coil former comprising aluminum using a thermally conductive fluxing material to provide a heat dissipating effect.

Peripheral portion 104 comprises a non-metallic material that may be paper, polypropylene, carbon fiber, plastic coated paper, or any other suitable non-metallic material having any suitable thickness. Therein, portion 104 is preferably formed in one piece and may even be injection molded, as for example in polypropylene, suitable because of its weather resistance for use in an exterior application such as public address.

Portion 104 comprises a substantially annular shape having an inner diameter D3 that is smaller than diameter D2 of the portion 104 so that they may overlap as taught further herein. An outer diameter D4 forms an outer edge of portion 104. Portion 104 comprises length 104*b* parallel to the longitudinal axis L-L.

Portions 102 and 104 are joined together at a peripheral edge 102*a*, 104*a* of each using an adhesive, such as oleoresin. Therein, edge 104*a* is an inner peripheral edge of portion 104 is joined to edge 102*a* which is an outer peripheral edge of portion 102 to form a lap 103. Herein, "inner" means more proximate to a center longitudinal axis L-L of the diaphragm than "outer." Lap 103 is preferably sized sufficiently to permit bonding. A dimension 103*a* taken along a portion of diameter defines the lap length which may be 5 mm.

In one or more embodiments, the voice coil former may be integral with portion 102. Thus, lower edge may extend beyond the voice coil former.

FIG. 5*d* is a partial cross-sectional view of a diaphragm in accordance with one embodiment of the present invention illustrating an embodiment wherein portions 102 and 104 have different angles. Therein, portion 102 has an angle A1 in the cross-section between lower edge 106 and a lowest most portion of peripheral edge 102*a*. However, peripheral edge 102*a* matches the angle A2 of portion 104. For example, angle A1 may be 135 degrees, while angle A2 may be 150 degrees.

Table 1 presents different speakers having motors made according to the present invention.

In the above table, CCAR means copper coated or clad aluminum wire which may be edge wound or flat wire wound on the voice coil former, EISV means wire polyester enameled copper wire which may have a high temperature paint finish, KSV means a polymide material which preferably is Kapton brand from DuPont of Wilmington, Del., U.S.A., and TIL means a glass fiber former. More, specifically "CCAR/0.20*0.65" means copper clad aluminum flat wire having a diameter of 0.20 mm by 0.65 mm flat wire for edge winding coils.

Herein, copper coated wire is used for low ohm value or resistance because it will conduct voltage and current more efficiently than aluminum wire. However, aluminum is much lighter and thermally conductive to a greater degree than copper and will increase the overall sensitivity of the motor in a magnetic field by being lighter. In accordance with the present invention, high efficiency with respect to thermal dissipation and low ohm value or resistance is needed to draw high current and voltage from a connected amplifier. Thus, clad or plated aluminum wire with copper is used in the voicecoils of the motors of the present invention to optimize these features. Using edgewound or flatwire, either as copper clad or aluminum wire, allows greater density of coils increasing the overall induction.

Table 2 illustrates the dimensions of one speaker of Table 1.

| Dimension | One 10 inch motor of Speaker E |
|---|---|
| D1 (mm) | 65 |
| D2 (mm) | 130 |
| Dimension 102b (mm) | 33.9 |
| Dimension 106a (mm) | 2.9 |

TABLE 1

| Speaker | A | B | C | D | E | F |
|---|---|---|---|---|---|---|
| Number and Size of Motors | 1 - 12 inch motor | 1 - 15 inch motor | 1 - 15 inch motor | 2 - 10 inch motors | 4 - 10 inch motors | 6 - 10 inch motors |
| Diaphragm Diameter D1 (inches) | 9.25 | 12.5 | 12.5 | 7.5 | 7.5 | 7.5 |
| Impedance (Ohm) | 4 | 4 | 8 | 8 | 8 | 6 |
| Resistance | 3.6 | 3.6 | 7.2 | 6.5 | 6.5 | 5.2 |
| Power rating (watts) | 200 | 200 | 400 | 100 | 250 | 250 |
| Voice coil inner diameter (mm) | 63.5 | 75.55 | 99.5 | 38.5 | 63.5 | 63.5 |
| Voice coil tube material/ thickness (mm) | KSV/0.13 | TIL/0.20 | TIL/0.20 | KSV/0.125 | TIL/0.20 | TIL/0.20 |
| Voice coil wire material | EISV/0.32 | CCAR/0.20*0.65 | CCAR/0.17*0.75 | EISV/0.22 | CCAR/0.14*0.60 | CCAR/0.15*0.65 |
| Voice coil winding width (mm) | 14.6 | 16.1 | 21 | 14.2 | 17.4 | 16.3 |
| No. of Turns of coil | 81 | 79 | 113.9 | 112 | 115 | 98.9 |
| Max. winding outer diameter (mm) | 65.19 | 77.45 | 101.8 | 39.81 | 65.5 | 65.6 |

-continued

| Dimension | One 10 inch motor of Speaker E |
|---|---|
| Metallic Portion 102 Surface Area 101a (square centimeters) | 275.14 |
| D3 (mm) | 120 |
| D4 (mm) | 190 |
| Dimension 104b (mm) | 19.4 |
| Non-Metallic Portion 104 Surface Area 101b (square centimeters) | 389.72 |

Herein, the motor of Table 2 illustrates the geometric dimensions of a diaphragm according to the present invention. A surface area 101*a* of the metallic portion 102 includes the area of the peripheral edge 102*a* of both the inner side (i.e. facing axis L-L) and outer side (i.e. facing the frame), but excludes the lower edge 106. Surface area 101*a* may be calculated by a geometric formula. Thus, for the diaphragm of FIGS. 5*a*-5*d*, area 101*a* may be calculated by a formula for a conical frustrum for each side; while the diaphragm of FIGS. 7*a*-7*c* may require a more complex calculation.

A surface area 101*b* of the non-metallic portion 104 includes the area of the peripheral edge 104*a* and an edge region which may be joined to the surround.

Thus, for the motor of Table 2, the ratio 1.0:1.41 of the surface area 101*a* of the metallic portion such as portion 102 to the surface area 101*b* of the non-metallic portion such as portion 104.

Preferably, the ratio is in the range of 1.0:1.0 to 1.0:2.50 of the surface area of the metallic portion such as portion 102 to the surface area of the non-metallic portion such as portion 104. However, other ratios may be possible.

Other motors 10, 40 may comprise diaphragms having any suitable ratio of surface areas. By varying the ratio, and, thus, varying the dimensions of the metallic portion 102 and the non-metallic portion 104, diaphragms having different uses are created. A motor for a bass speaker may have a ratio of surface areas that is different from a diaphragm in a motor of a public address speaker. By varying the ratio it is also possible to provide a unique sound for certain musical instruments, i.e. voice the instrument.

A comparison test of speaker motors was conducted on 12 inch and 15 inch motors by apply a 100 watt "Pink Noise" load for one (1) hour to motors built according the present invention and paper motors. Herein, "Pink Noise" is a load that has equal energy in all octaves.

FIG. 6*a* is a graph tracing the sound pressure level for a certain frequency range and a resistance for a certain frequency range for a 12 inch motor built according to the present invention and incorporated in a speaker. FIG. 6*b* is a graph tracing the sound pressure level for a certain frequency range and a resistance for a certain frequency range for a 15 inch motor built according to the present invention and incorporated in a speaker.

Therein, the 12 inch and 15 inch motors used in the comparison tests are respectively speakers A and B in Table 1 and use the structure as taught with respect to FIGS. 3 and 4 and include a neodymium magnet.

Returning to FIG. 6*a*, speaker A and a correspondingly sized paper cone motor were tested to determine the frequency response. A trace 202*a* comparing sound pressure level in decibels (left-most y-ordinal) during a broad frequency range in Hz (the x-ordinal) was obtained using an LMS test system with a calibrated test microphone located 1 meter from the motor. A trace 202*b* comparing resistance in Ohm (right-most y-ordinal) during a broad frequency range in Hz (the x-ordinal) was also obtained. Similar traces 204*a*, 204*b*, respectively, under similar test conditions were obtained for the corresponding paper diaphragm motor having a similar motor and magnet assembly configuration.

A greater sound pressure level was obtained using the motor of the present invention especially in the regions 206 and 208. For example, region 206 is useful for a bass speaker, where frequencies in the 200-400 Hz region are considered high frequency. Thus, a bass speaker using a motor of the present invention would be able to have higher frequency response than a bass speaker simply using a paper diaphragm motor.

Region 208 indicates that a motor used in all-purpose conditions would provide markedly better results than a corresponding paper diaphragm motor.

FIG. 6*b* illustrates similar results. Therein, speaker B and a correspondingly sized paper cone motor were tested to determine the frequency response. A trace 212*a* comparing sound pressure level in decibels (left-most y-ordinal) during a broad frequency range in Hz (the x-ordinal) was obtained using an LMS test system with a calibrated test microphone located 1 meter from the motor. A trace 212*b* comparing resistance in Ohm (right-most y-ordinal) during a broad frequency range in Hz (the x-ordinal) was also obtained. Similar traces 214*a*, 214*b*, respectively, under similar test conditions were obtained for the corresponding paper diaphragm motor having a similar motor and magnet assembly configuration.

A greater sound pressure level was obtained using the motor of the present invention especially in the regions 216 and 218. For example, region 216 is useful for a bass speaker, where frequencies in the 200-400 Hz region are considered high frequency. Thus, a bass speaker using a motor of the present invention would be able to have higher frequency response than a bass speaker simply using a paper diaphragm motor.

Region 218 indicates that a motor used in all-purpose conditions would provide markedly better results than a corresponding paper diaphragm motor.

FIGS. 6*a* and 6*b* indicate via traces 202*a*, 212*a*, and 204*a*, and 214*a* that speakers A and B over the test range have a significantly reduced electrical resistance including a peak resistance that is less than that of the corresponding paper diaphragm motor. Furthermore, the peak resistance has shifted to a higher frequency range.

These improvements are attributable to a difference of 5 degrees Centigrade in the gap temperature between Speakers A and B in comparison to the corresponding paper diaphragms after a one (1) hour test run with the Pink Noise load described above.

Therein, the inventive diaphragm provided heat dissipation from the voice coil. The heat dissipation value H of the inventive diaphragm, i.e. Hartke® value, may be defined as the surface area 101*a* of the metallic portion 102 of FIG. 5*a* et al. or 302 in FIG. 7*a* et al. in square meters, as for example, that used in Table 2 multiplied by the coefficient of thermal conductivity k. Thus, $$H=A\times k \qquad \text{Equation 1}$$

Where A is the surface area of the metallic portion in square meters and k is a constant as determined by $$k=\frac{Q}{t}\times\frac{L}{A\times\Delta T} \qquad \text{Equation 2}$$

Equation 2 reads as follows thermal conductivity=heat flow rate×distance/(area×temperature difference).

Pure aluminum has a generally accepted coefficient of thermal conductivity k of 220 according to Equation 2, while pure copper has a coefficient k of 390. See for example the 87th Edition of the CRC Handbook of Chemistry and Physics as source of values of k including for sources of non-metallic material that may be used in the "metallic portion" 102 or 302.

Thus, for the motor of Table 2, A=1/1000 multiplied by 275.14 $cm^2$ multiplied by the metallic material constant of 220 yields an H value of 60.53 for aluminum. Similarly, the H value using pure copper is 107.30. In contrast, air has a generally accepted thermal conductivity of 0.025, providing a base value for the motor of Table 2 of 0.007.

It is preferred that the diaphragm of the present invention have an H value of at least 20.0 or greater to effectively dissipate heat.

While metallic or nonmetallic material used 102 or 302 may not be pure, the heat dissipation value H may be used to compare and determine the effectiveness of a diaphragm in accordance with one embodiment of the present invention.

The heat dissipation is further improved by the use of a frame, such as frames 12, 42, that dissipate heat by being made of cast aluminum or similar metallic or non-metallic material. To quantify the effectiveness of different types of heat sinks, the volumetric heat transfer efficiency, also called an n-value, can be defined as $$\eta = \frac{Q}{\dot{m}c\Delta T_{sa}} \qquad \text{Equation 3}$$

where, m is the mass flow rate through the heat sink, c is the heat capacity of the fluid, and $\Delta T_{sa}$ is the average temperature difference between the heat sink and the ambient air.

For a diaphragm built in accordance with one or more embodiments of the present invention with an aluminum cast frame the n-value is increased and the increased n-value, expressed as percent is 15-22%, which is an advantage in cooling the voice coil. Preferably, the motor built in accordance with one embodiment of the present invention has an increased n-value of at least 10%.

Thus, by the present invention it is possible to increase the power of the motor. For example, the number of windings on the voice coil may be increased without increasing the ambient temperature in the motor.

FIGS. 7*a*, 7*b*, and 7*c* are, respectively, a perspective view, a planar view, and a cross-sectional view of a diaphragm in accordance with a further embodiment of the present invention. Diaphragm 300 includes a plurality of peripheral portions 302 and 304. Therein, peripheral portion 302 includes a lower edge 306 that is connected to a voice coil 308 (generally indicated by broken lines), which itself is identical or substantially identical to those described above or those taught with respect to Table 1 above.

Peripheral portion 302 preferably comprises a metallic material, while portion 304 comprises a non-metallic portion. In the present embodiment, unlike the prior embodiment, portion 302 extends in some regions to the base 300*a* of the diaphragm and provide additional heat dissipation.

Therein, portion 302 includes a peripheral edge 302*a* while portion 304 includes a peripheral edge 304*a* which overlaps edge 302*a*. The portions are joined at the edges follow a path until the reach base 300*a*.

FIGS. 8*a* and 8*b* are a planar view of a diaphragm 350 in accordance with one embodiment of the present invention illustrating enhancements to metallic diaphragm portion. Therein, diaphragm 350 substantially similar to a diaphragm taught before includes one or more of the nonmetallic portions 354 and metallic portions 352. The metallic portions 352 may be anodized and/or colored 352*a*. To permit efficient anodization, the metallic portions may comprise aluminum or titanium.

In such an application, it may be preferred that a motor having such a colored and/or anodized diaphragm is housed in a partially open enclosure to make the colored and/or anodized portions visible.

For example, in the automotive audio field it is desirable to have audio equipment that provides a distinctive visual appeal to the buyer. Thus, metallic portion may include a design 355 as illustrated in FIG. 8*b*.

While the invention has been described in conjunction with specific embodiments, it is to be understood that many alternatives, modifications, and variations will be apparent to those skilled in the art in light of the foregoing description.

What is claimed is:

1. A diaphragm for a speaker, the diaphragm comprising: a first portion of a first material for producing a high frequency tone, the first portion being joined at a first peripheral edge of the first portion to a voice coil, a second portion of a second material for producing a low frequency tone, the second portion being joined directly at a first peripheral edge of the second portion to a second peripheral edge of the first portion and at a second peripheral edge of the second portion to a diaphragm support.

2. The diaphragm of claim 1, wherein the first material comprises a metallic portion comprising one of aluminum, titanium, magnesium, and an alloy thereof.

3. The diaphragm of claim 2, wherein the metallic portion is anodized.

4. The diaphragm of claim 2, wherein the metallic portion includes a design.

5. The diaphragm of claim 1, wherein the second material comprises a non-metallic portion comprising one of paper, polypropylene, carbon fiber, and plastic coated paper.

6. The diaphragm of claim 1, wherein a ratio of the surface area of the first portion to the second portion is 1.0:1.0 to 1.0:2.50.

7. The diaphragm of claim 1, wherein at least a part of the second peripheral edge of the first portion is supported by the diaphragm support.

8. A speaker motor comprising:

a frame; a neodymium iron boron magnet assembly disposed in the frame;

a voice coil suspended in a gap of the magnet assembly; a diaphragm having a first portion of a first material for producing a high frequency tone, the first portion being joined at a first peripheral edge of the first portion to the voice coil, a second portion of a second material for producing a low frequency tone, the second portion being joined directly at a first peripheral edge of the second portion to a second peripheral edge of the first portion and at a second peripheral edge of the second portion to a diaphragm support of the frame.

9. The speaker motor of claim 8 wherein the diaphragm dissipates heat from the voice coil.

10. The speaker motor of claim 8 wherein the diaphragm provides an increase in sound pressure level in the frequency range of 4000 Hz to 20000 Hz over a comparable paper cone diaphragm motor.

11. The speaker motor of claim 8 wherein the diaphragm provides an increase in the n-value in accordance with the formula $n=Q/mc\Delta T_{sa}$.

12. The speaker motor of claim 8 wherein the first material comprises one of aluminum, titanium, magnesium, and an alloy thereof.

13. The speaker motor of claim 8 wherein the second material comprises one of paper, polypropylene, carbon fiber, and plastic coated paper.

14. The speaker motor of claim 8 wherein a ratio of the surface area of the first to the second portion is 1.0:1.0 to 1.0:2.50.

15. A speaker comprising: an enclosure; and a speaker motor joined to the enclosure, the speaker motor including a frame; a neodymium iron boron magnet assembly disposed in the frame; a voice coil suspended in a gap of the magnet assembly; a diaphragm having a first portion of a metallic material for producing a high frequency tone, the first portion being joined at a first peripheral edge of the first portion to the voice coil, a second portion of a non-metallic material for producing a low frequency tone, the second portion being joined directly at a first peripheral edge of the second portion to a second peripheral edge of the first portion and at a second peripheral edge of the second portion to a diaphragm support of the frame.

16. The speaker of claim 15 wherein the first portion comprises one of aluminum, titanium, magnesium, and an alloy thereof.

17. The speaker of claim 15 wherein the second portion comprises one of paper, polypropylene, carbon fiber, and plastic coated paper.

18. The speaker of claim 15 wherein a ratio of the surface area of the first portion to the second portion is 1.0:1.0 to 1.0:2.50.

* * * * *